US007124538B1

(12) United States Patent
Kline

(10) Patent No.: US 7,124,538 B1
(45) **Date of Patent: *Oct. 24, 2006**

(54) ASSEMBLY PROVIDING A WATER RESTRICTIVE BARRIER AND AN UNOBSTRUCTED PASSAGEWAY FOR A DOORWAY

(76) Inventor: C. Walter Kline, 2763 SW. 6th St., Delray Beach, FL (US) 33445

( * ) Notice: Subject to any disclaimer, the term of this patent is extended or adjusted under 35 U.S.C. 154(b) by 0 days.

This patent is subject to a terminal disclaimer.

(21) Appl. No.: 11/037,632

(22) Filed: Jan. 18, 2005

Related U.S. Application Data

(63) Continuation-in-part of application No. 10/689,350, filed on Oct. 20, 2003, now Pat. No. 6,871,448.

(51) Int. Cl.
*E06B 7/28* (2006.01)

(52) U.S. Cl. ..... 49/316; 49/209; 49/320; 49/321; 49/304; 49/319

(58) Field of Classification Search ..... 49/209, 49/216, 281, 301, 316, 319, 320, 321, 303, 49/304, 305; 405/114, 115; 52/167.14
See application file for complete search history.

(56) References Cited

U.S. PATENT DOCUMENTS

| | | | | | |
|---|---|---|---|---|---|
| 974,959 | A | * | 11/1910 | Gotte | 49/319 |
| 1,005,114 | A | * | 10/1911 | Hamlin | 49/319 |
| 1,494,329 | A | | 5/1924 | Austin | |
| 2,161,108 | A | * | 6/1939 | Thomas | 49/321 |
| 2,248,719 | A | * | 7/1941 | Owen | 49/25 |
| 3,225,393 | A | * | 12/1965 | Coller | 49/213 |
| 3,660,936 | A | * | 5/1972 | Bryson | 49/209 |
| 3,947,998 | A | * | 4/1976 | Matsubara | 49/209 |
| 4,089,136 | A | | 5/1978 | Lapinski et al. | |
| 4,145,093 | A | * | 3/1979 | Sekerich | 384/19 |
| 4,237,664 | A | | 12/1980 | Wilmes | |
| 4,406,088 | A | | 9/1983 | Berndt, Jr. | |
| 4,432,164 | A | | 2/1984 | Baguet | |
| 4,437,266 | A | | 3/1984 | Keller | |
| 4,562,667 | A | * | 1/1986 | von Resch | 49/176 |
| 4,644,690 | A | * | 2/1987 | Caimi | 49/130 |
| 4,692,961 | A | | 9/1987 | Brown | |
| 4,703,586 | A | | 11/1987 | Smith et al. | |
| 4,805,345 | A | | 2/1989 | Ohi | |
| 4,930,256 | A | * | 6/1990 | Kawanishi et al. | 49/209 |
| 5,029,911 | A | * | 7/1991 | Daniels | 292/170 |
| 5,422,552 | A | * | 6/1995 | Parisi | 318/466 |
| 5,560,164 | A | | 10/1996 | Ahrens | |

(Continued)

FOREIGN PATENT DOCUMENTS

| | | | |
|---|---|---|---|
| JP | 11182154 | A | 7/1999 |

*Primary Examiner*—Gregory J. Strimbu
(74) *Attorney, Agent, or Firm*—Malloy & Malloy, P.A.

(57) ABSTRACT

A doorway assembly, preferably for a sliding door, includes a barrier plate extending across the lower portion of the doorway to prevent the intrusion of water during severe weather conditions. A notch within the barrier plate, provides a substantially obstruction-free passageway through the doorway and, is sealed by compressing a compressible gasket, attached to a compression panel mounted to move with the sliding door, against the barrier plate. An actuator is structured to move the compression panel toward the barrier plate in response to operation of a latch lever, thereby compressing the compressible gasket and providing a seal between the compression panel and the barrier plate adjacent the notch.

7 Claims, 10 Drawing Sheets

U.S. PATENT DOCUMENTS

| | | | | |
|---|---|---|---|---|
| 5,642,588 | A | 7/1997 | Sowers | |
| 5,870,859 | A | 2/1999 | Kitada | |
| 5,887,387 | A | 3/1999 | Dallaire | |
| 6,017,105 | A | 1/2000 | Goughnour et al. | |
| 6,082,047 | A | 7/2000 | Comaglio et al. | |
| 6,125,584 | A | 10/2000 | Sanders | |
| 6,170,207 | B1 | 1/2001 | Saindon | |
| 6,195,939 | B1 | 3/2001 | Sowers | |
| 6,497,072 | B1 * | 12/2002 | Fries | 49/209 |
| 6,826,867 | B1 * | 12/2004 | McDonald et al. | 49/213 |
| 6,871,448 | B1 * | 3/2005 | Kline | 49/319 |
| 2004/0098915 | A1 * | 5/2004 | Baldry | 49/339 |

* cited by examiner

ASSEMBLY PROVIDING A WATER RESTRICTIVE BARRIER AND AN UNOBSTRUCTED PASSAGEWAY FOR A DOORWAY

CLAIM OF PRIORITY

This application is a continuation-in-part of U.S. patent application Ser. No. 10/689,350 filed on Oct. 20, 2003, incorporated by reference in its entirety herein, and which matured into U.S. Pat. No. 6,871,448 on Mar. 29, 2005.

BACKGROUND OF THE INVENTION

1. Field of the Invention

This invention relates to an assembly providing a water resistant barrier for at least a lower portion of a doorway, as well as an unobstructed passageway through the doorway. The invention may be incorporated into a new doorway assembly comprising integral construction, or it may be utilized to retrofit an existing doorway assembly and its corresponding passageway.

2. Description of the Related Art

In many areas prone to high velocity winds and rain, a watertight barrier is provided to prevent water intrusion into a building. For example, the threshold frame member forming the lower portion of the frame structure extending around a sliding door is provided inside the door with a leg extending upward from the floor to a height required to accommodate a particular water level or design pressure. The problem with this approach is that the barrier presents a tripping hazard to people walking through the open doorway, and a serious obstacle to anyone trying to roll a wheelchair or wheeled cart through the door opening. There are numerous instances of conflict between building codes requiring such barriers to prevent damages from water penetration and federal regulations covering ADA (Americans with Disabilities Act) Standards for Accessible design.

In some locations, these problems can be alleviated by building ramps extending downward from the top of the obstruction to the surfaces inside and outside the building. However, when such ramps are built at the degree of slope mandated for wheelchair usage, they are often too long to be used with narrow walkways, balconies or patios outside or with small rooms inside. Therefore, what is needed is a mechanism for sealing against water intrusion that moves out of the way, as a sliding door is opened.

Sliding doors of vehicles, such as vans, and of many railroad freight cars, are provided with airtight sealing mechanisms that are additionally watertight at least under rain conditions, with the door being mounted on cranks that allow it to move inward into the mating opening and outward therefrom. The sealing process occurs as the door is moved inward, and the seals are broken as the door is moved outward. While the door is held outward by the cranks, it is slid along the outside of the wall of the vehicle or railroad car. What is needed is a way for providing a watertight opening at a sliding door within a building where weather conditions include high winds and rain, without requiring a different type of door movement and without significantly changing the appearance of the building when the door is open.

U.S. Pat. No. 5,870,859 describes a watertight sliding door structure including a movable door, a stationary door, which is made watertight without increasing the height of a portion of the sill. The movable door and the stationary door are each provided with a stile extending vertically along the central edge of the door. As the movable door is closed, these stiles meet one another, with the gap between them being sealed by elastomeric strips. Horizontally extending sealing strips are also provided along the upper and lower frame members of the doors. A pressure-equalized clearance area is formed between the sill of the window frame of the movable door and the stationary door and attachments provided on the sill. Additionally, an airtight member is provided to divide the pressure-equalized clearance area into an inside clearance area of the single movable door. By forming the pressure-equalized clearance area between the inside clearance area and the outside clearance area of the single movable door in the sill partition, a difference in the pressure between the sill portion and the outside is not produced, so that rain water is exhausted by a dead load. What is needed is a method for sealing a doorway assembly without requiring a movable door to be slid open and shut with elongated sealing members in sliding contact with opposing surfaces.

Japanese Patent Application 11182154A describes a water barrier plate that moves vertically with the movement of a flexible door extending around the walls of a stall within a bathroom. The door is opened by moving the flexible door so that a space between its opposite ends is aligned with an opening in the walls, with pins at these opposite ends moving the water barrier plate downward into a slot within the threshold as the door is fully opened. The door is closed by moving the flexible door so that the space between these opposite ends is aligned within the walls, with these pins moving the water barrier plate upward within the slot. What is needed is a water barrier that can be moved out of the way without causing the barrier to retract into a slot extending downward within the floor, so that there is no need to weaken the floor structure with such a slot, and so that the assembly can be readily installed in an existing building. Additionally, what is needed is an assembly operable with a conventional sliding door, in which the entire door moves to one side of a passageway as it is opened.

U.S. Pat. Nos. 4,692,961 and 5,560,164 describe water-shielding structures for removable placement in openings of buildings. What is needed is a structure that can be left attached within a doorway without impeding traffic through the passageway.

A number of patents, such as U.S. Pat. No. 4,237,664, describe door sill structures including surfaces of different elevations to prevent water intrusion without addressing the difficulties in access by foot or wheelchair that may be caused by such changes in elevation.

Thus, it would be beneficial to provide a doorway assembly comprising a sealing apparatus which seals against water intrusion and which is readily disposable in and out of a sealable orientation by simply closing and opening a door, respectively. It would also be helpful for such a doorway assembly to provide an unobstructed passageway through the doorway while the door is open. In addition, it would be preferable for such a doorway assembly to comprise integral construction of a sealing apparatus so as to facilitate installation of the assembly in new construction. Further, it would be helpful to provide such a doorway assembly without significantly changing a door movement or an appearance of a doorway, whether the door is open or closed. Additionally, it would be beneficial to provide such a doorway assembly for use with a conventional sliding door, in which the sliding door is disposed to essentially one side of the doorway while open, so as to provide an unobstructed passageway through the doorway.

SUMMARY OF THE INVENTION

In one embodiment of the present invention, an assembly is provided for sealing a notch within a barrier plate extending across a lower portion of an opening covered by a sliding door movable between open and closed positions. The assembly includes a compression panel, a carrier bracket, a compressible gasket, and an actuator. The carrier bracket is attached to the sliding door. The compression panel is mounted within the carrier bracket to be movable both toward the barrier plate and away from the barrier plate. The compressible gasket is disposed adjacent the notch with the sliding door in the closed position. The actuator is disposed adjacent the compression panel with the sliding door in the closed position. The actuator is mounted to move along a stationary surface between a disengaged and an engaged position. Movement of the actuator into the engaged position with the sliding door in the closed position causes the compression panel to be moved via contact with the actuator toward the barrier plate, the compressible gasket contacting the barrier plate and, thus, being compressed. Movement of the actuator into the disengaged position with the sliding door in the closed position allows movement of the compression panel in contact with the actuator away from the barrier plate, releasing compression of the compressible gasket against the barrier plate.

In one other embodiment of the present invention, the assembly additionally includes a sliding door and a frame mounting the sliding door to move between open and closed positions, with the frame including a barrier plate having a notch forming a part of a passageway covered by the sliding door in its closed position.

In at least one embodiment, the actuator includes an elongated member extending adjacent the compression panel with the sliding door in the closed position, with the assembly additionally including stationary ramps disposed adjacent opposite ends of the stationary member. The actuator then moves along the stationary ramps between the disengaged position and the engaged position, with the stationary ramps being inclined to move the actuator toward the barrier plate in contact with the compression panel with the sliding door in the closed position as the actuator is moved into the engaged position.

In addition, the present invention contemplates a method for retrofitting a passageway enclosed by a door sliding within a frame having a barrier plate extending upward to form a lower edge of the passageway. This method includes making a notch within the barrier plate along the lower edge of the passageway; attaching a carrier bracket to the sliding door; mounting a compression panel on the carrier bracket to be movable both toward the barrier plate and away from the barrier plate; mounting a compressible gasket disposed to extend adjacent the notch in a contacting position with the barrier plate, with the sliding door in the closed position; and mounting the actuator adjacent the compression panel with the sliding door in the closed position.

In one further embodiment, the assembly of the present invention comprises a doorframe including a barrier plate, the barrier plate having at least one notch structured to provide a substantially unobstructed passageway through the doorway. A door is disposed in an operative association with the doorframe such that the door is movable between an open position and a closed position. A compression panel is interconnected to the door and is, thus, moveable with the door, and the compression panel is structured to be disposed into and out of a sealing engagement with the barrier plate.

In at least one embodiment, a compressible gasket is mounted to the compression panel. In this embodiment, the sealing engagement is at least partially defined by the compressible gasket contacting the barrier plate proximate the notch and forming a fluid impervious seal so as to substantially prevent passage of liquid between the compression panel and the barrier plate, at least at the notch. In one further embodiment, the compression panel may also comprise a retracting device structured to dispose the compression panel out of the sealing engagement with the barrier plate.

Additionally, in the aforementioned embodiment, an actuator is interconnected to the door and is also moveable therewith. The actuator is structured to operatively engage a portion of the compression panel and to dispose the compression panel into sealing engagement with the barrier plate. In one embodiment, the actuator comprises an elongated member which is disposed adjacent to and is movable along a portion of at least a first abutment surface, thereby disposing the elongated member between an engaged position and a disengaged position. Further, the elongated member has at least a first rotatable mechanism mounted thereto which is disposed in contact with at least a portion of the first abutment surface. The elongated member may also include a second rotatable mechanism mounted thereto which is disposed in contact with at least a portion of a second abutment surface.

These and other objects, features and advantages of the present invention will become more clear when the drawings as well as the detailed description are taken into consideration.

BRIEF DESCRIPTION OF THE DRAWINGS

For a fuller understanding of the nature of the present invention, reference should be made to the following detailed description taken in connection with the accompanying drawings in which.

Like reference numerals refer to like parts throughout the several views of the drawings.

DETAILED DESCRIPTION OF THE PREFERRED EMBODIMENT

Figure 1:
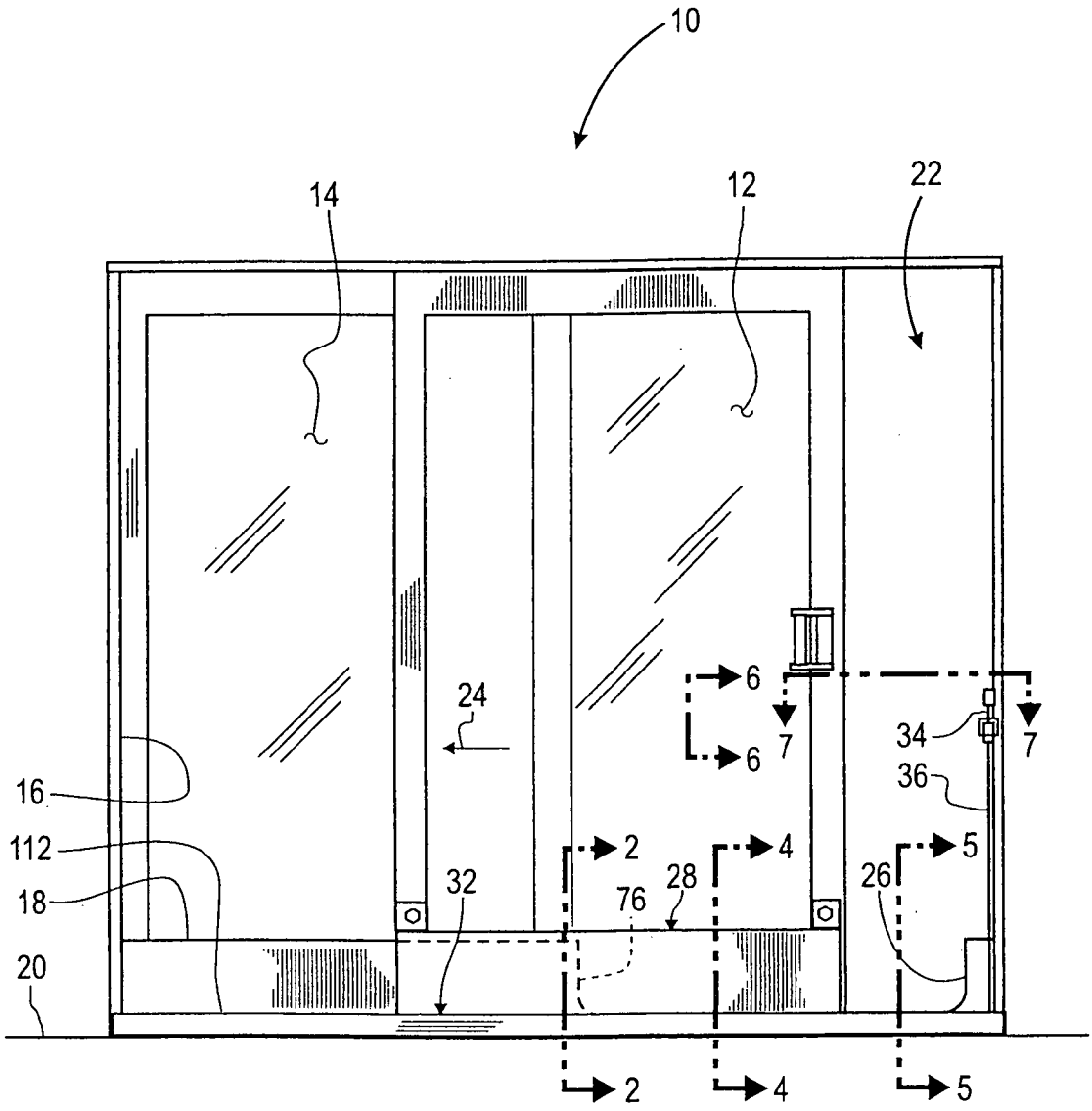
FIG. 1 is front elevation of one embodiment of a doorway assembly built in accordance with the present invention, shown with a sliding door therein partly open.

While this invention is susceptible of embodiment in many different forms, there is shown in the drawings and will herein be described in detail at least one specific embodiment, with the understanding that the present disclosure is to be considered as an exemplification of the principles of the invention and is not intended to limit the invention to the embodiment illustrated.

FIG. 1 is a front elevation of one embodiment of a doorway assembly 10 built in accordance with the invention, as viewed from inside a structure. The doorway assembly 10 includes a door which, for illustrative purposes in the present specification comprises a sliding door 12 and a stationary door 14 outwardly disposed from the sliding door 12, and a doorframe 16. It is understood to be within the scope and intent of the present invention to apply the invention to other types of door configurations, such applications being readily apparent to those skilled in the art.

To provide the various features of the invention, the doorway assembly 10 additionally includes a barrier plate 18 extending upward from a floor 20 to prevent water penetration. To avoid presenting a tripping hazard to individuals walking through the passageway 22 within the doorframe 16 with the sliding door 12 moved in the direction of arrow 24 into its open position, and further to avoid presenting a barrier to wheelchair access through this passageway 22, the barrier plate 18 includes a notch 26 extending downward to enlarge this passageway 22.

In order to maintain the water sealing function of the barrier plate 18, the notch 26 is sealed by means of a compression panel subassembly 28 which, in one embodiment, is attached to the sliding door 12 by bolts 30, to move out of the passageway 22 when the sliding door 12 is opened. Of course, the compression panel subassembly 28 may be attached to the sliding door 12 by any known fastening mechanism including, but not limited to nails, screws, rivets, welds, solder, adhesives, etc.

The doorway assembly 10 additionally includes an actuator subassembly 32 which, in at least one embodiment, extends along the floor 20 adjacent the compression panel subassembly 28. When the sliding door 12 is in its closed position, the actuator subassembly 32 operates in response to movement of a latch lever 34 connected to the actuator subassembly 32 by means of a flexible member 36 to seal the notch 26 to prevent water damage and to release seal on the notch 26 to allow movement of the sliding door 12. The flexible member 36 may comprise a steel cable, however, it is understood that the flexible member 36 may alternately comprise, for example, a flexible plastic strap, a monofilament line, a composite line, or a braided rope or wire, just to name a few.

Figure 2:
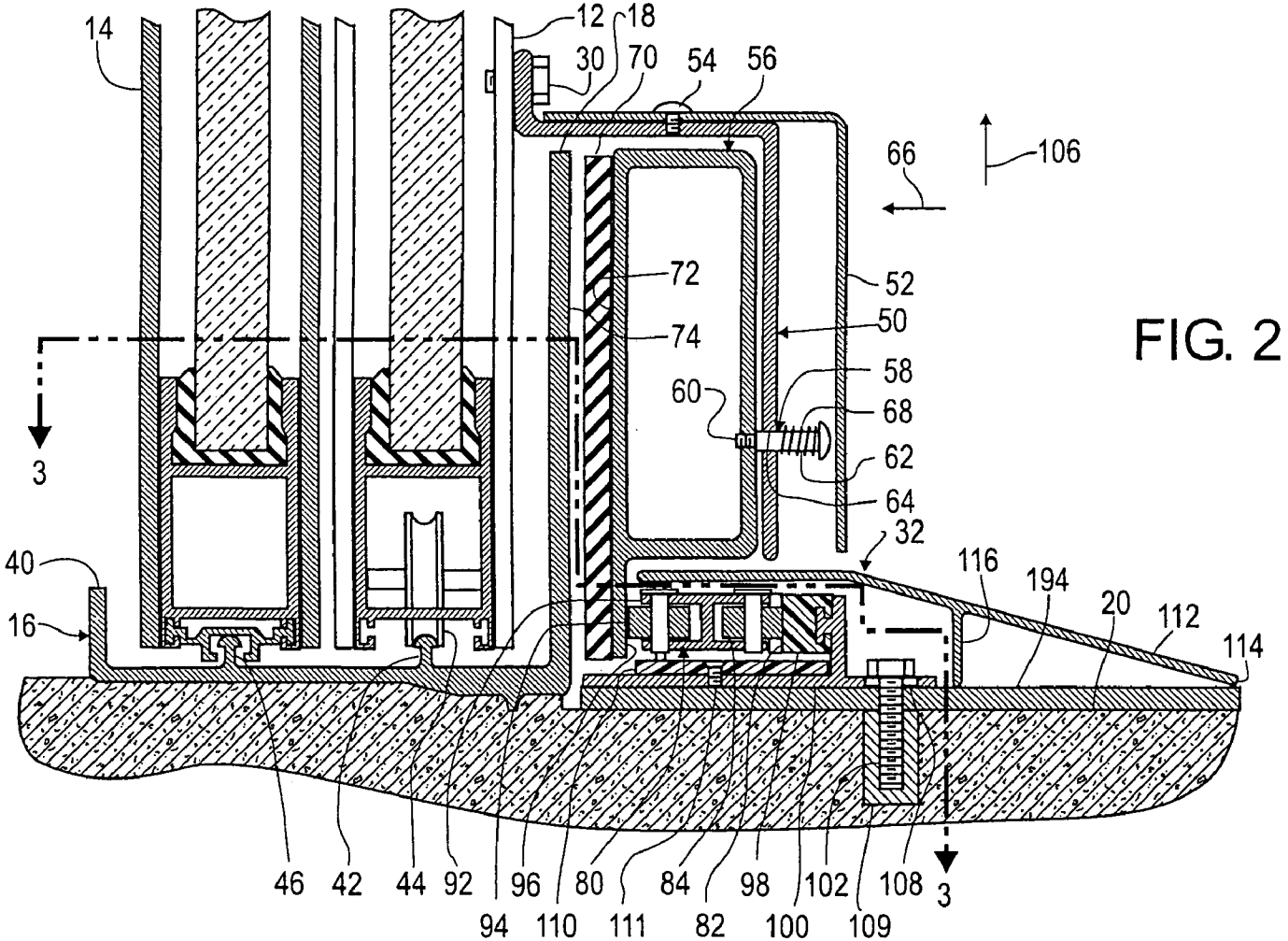
FIG. 2 is a fragmentary cross-sectional elevation of the door assembly of FIG. 1 along lines 2—2 thereof showing a compression panel subassembly and an actuator subassembly.

FIG. 2 is a fragmentary cross-sectional elevation of the doorway assembly 10, taken as indicated by section line 2—2 in FIG. 1. The barrier plate 18 is shown to be an upstanding portion of a threshold frame member 40, which forms a lower portion of the doorframe 16. The sliding door 12 is movably mounted on an inner rail 42 of the threshold frame member 40 by means of a number of rollers 44, while the stationary door 14 rests on an outer rail 46 of the threshold frame member 40.

Figures 15, 15A:
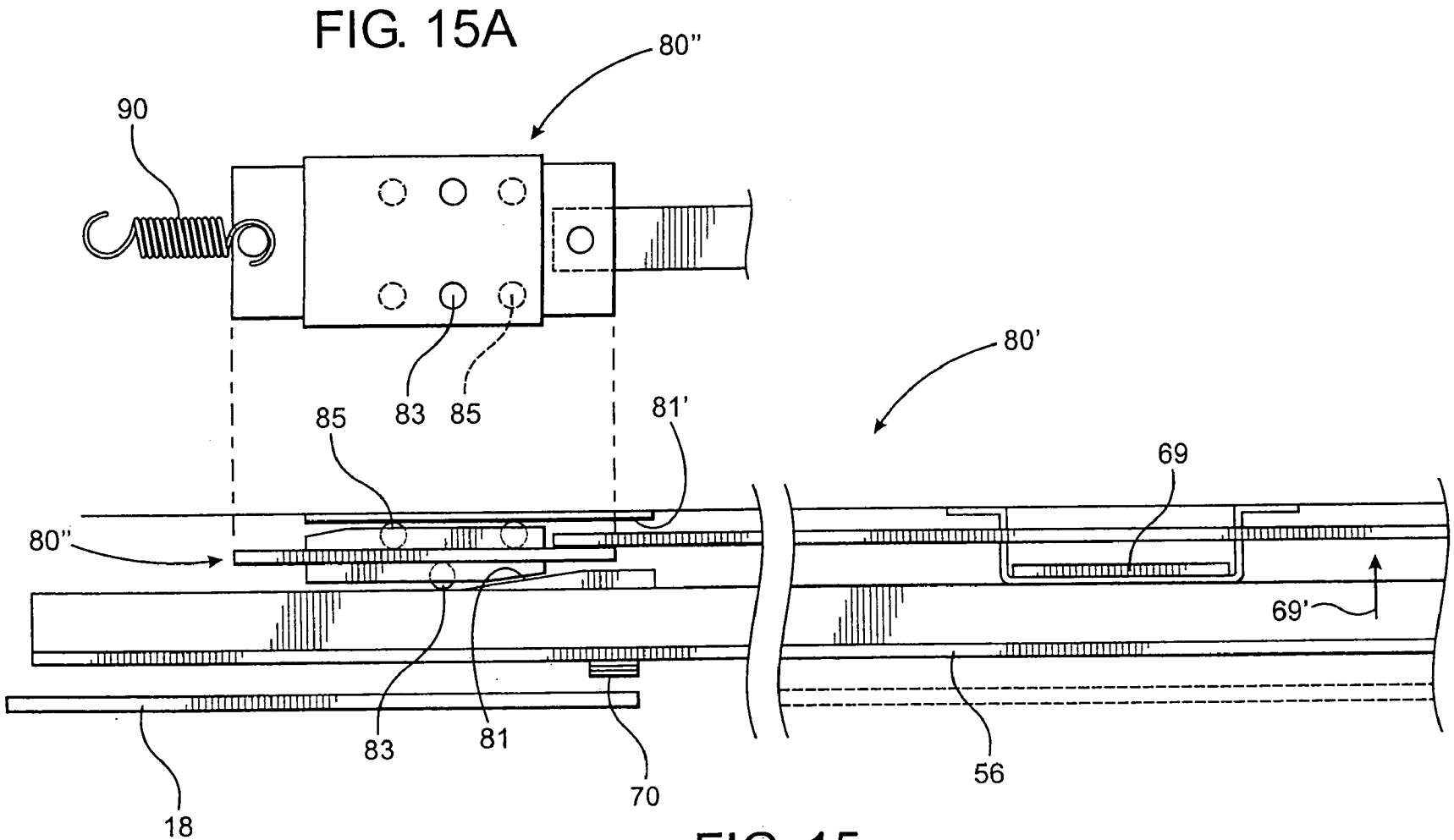
FIG. 15 is a partial plan view of one preferred embodiment of an actuator of the present invention and further illustrating a retracting device comprising at least one magnet.
FIG. 15A is a partial elevation of the embodiment of the actuator of FIG. 15.

In one embodiment, the compression panel subassembly 28 includes a panel mounting bracket 50 attached to the sliding door 12 by the screws 30, a decorative cover 52 fastened to the panel mounting bracket 50 by means of a number of screws 54, and a compression panel 56 which, in at least one embodiment, is slidably mounted on the panel mounting bracket 50 by means of a number of shoulder screws 58. The upper surface of the compression panel 56 is as high as the upper surface of the barrier plate 18, as illustrated throughout the figures. Each of the shoulder screws 58, which is attached to the compression panel 56 by threads 60, includes a shoulder 62 sliding within a hole 64 in the panel mounting bracket 50. In this way, the compression panel 56 is mounted to move in and opposite the engagement direction of arrow 66. In at least one embodiment, the compression panel 56 comprises a retracting device such as, for example, a number of compression springs 68 structured to push the compression panel 56 away from the barrier plate 18 in the direction opposite arrow 66 through the shoulder screws 58. In one preferred embodiment, the retracting device may comprise one or more magnets 69 structured and disposed to provide sufficient force to pull the compression panel 56 away from the barrier plate 18, in the direction of arrow 69', as illustrated in FIG. 15.

Figure 3:
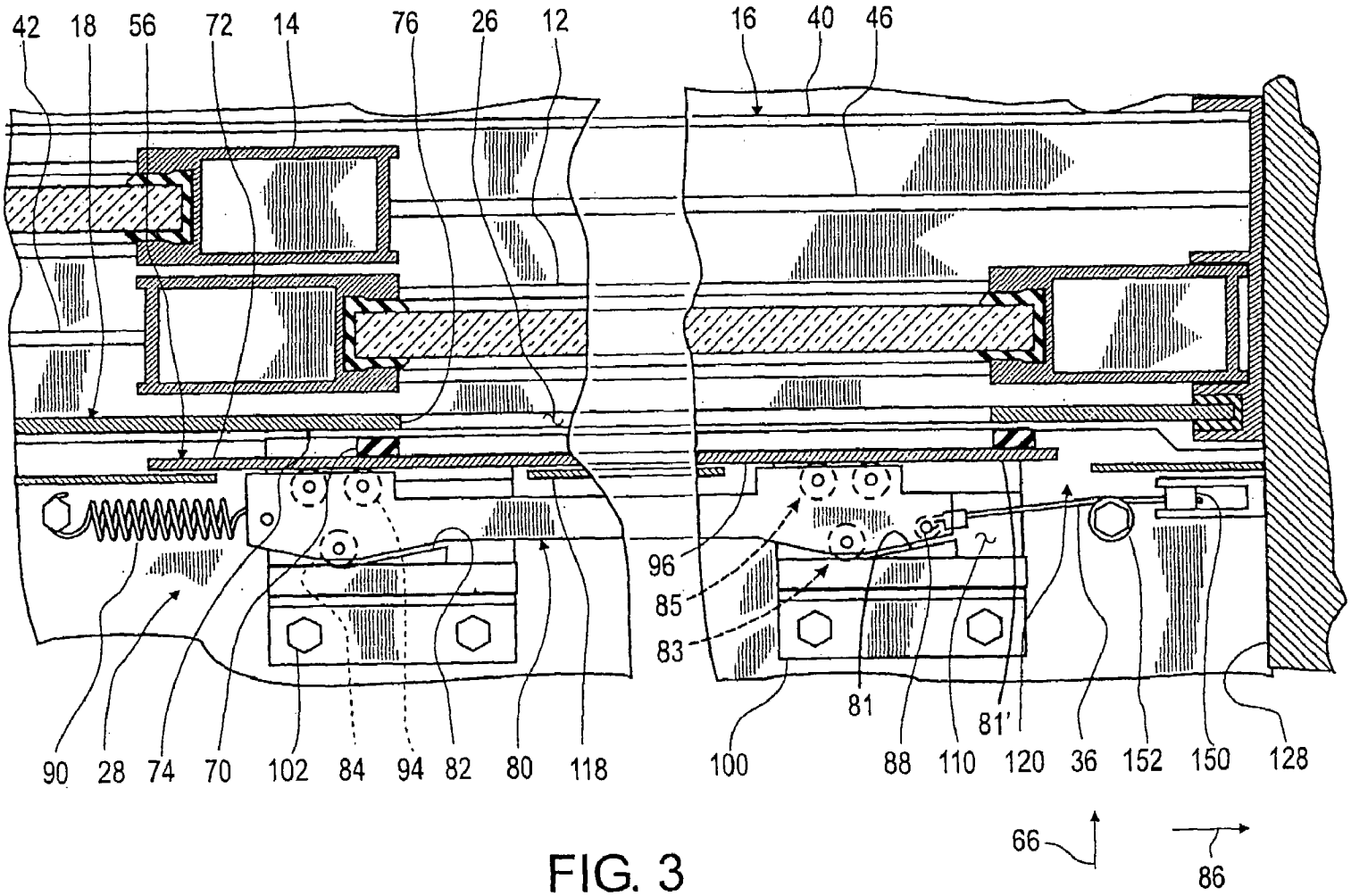
FIG. 3 is a fragmentary cross-sectional plan view of the doorway assembly of FIG. 1 along lines 3—3 of FIG. 2.

FIG. 3 is a fragmentary cross-sectional plan view of the doorway assembly 10, taken as indicated by section line 3—3 in FIG. 2. While FIGS. 1 and 2 show the sliding door 12 partly open, FIG. 3 shows the sliding door 12 fully closed. Referring to FIGS. 2 and 3, a compressible gasket 70 is attached to an outer surface 72 of the compression panel 56. The compressible gasket 70 extends adjacent the notch 26 in the barrier plate 18, so that, when the compression panel 56 is driven in the engagement direction of arrow 66, the compressible gasket 70 is compressed between the outer surface 72 of the compression panel 56 and the inner surface 74 of the barrier plate 18 within an area extending adjacent the notch 26 forming a seal so as to substantially prevent the passage of liquid between the compression panel 56 and the barrier plate 18, thereby, at least partially defining a sealing engagement. Both FIGS. 2 and 3 are cross-sectional views taken through a vertically extending portion of the compressible gasket 70 adjacent an end 76 of the notch 26. As used throughout this specification, "compressible" means that the gasket 70 is formed of a material that will at least partially compress under a nominal load against the barrier plate 18 so as to form a fluid impervious seal around the notch 26, as discussed below.

As illustrated in the embodiment of FIGS. 2 and 3, the actuator subassembly 32 includes an actuator 80 movable along a first abutment surface 81 such as, for example, a pair of inclined surfaces 82, by means of a first rotatable mechanism 83 which, in this embodiment, comprises rollers 84. As illustrated in FIGS. 2 and 3, the inclined surfaces 82 are mounted opposite the compression panel 56, however, it is understood to be within the scope and intent of the present invention for the first abutment surface 81 to be alternatively mounted to the compression panel 56.

The actuator 80 is pulled to the right, in the direction of arrow 86, by means of the flexible member 36 attached to the actuator 80 by a pin 88, which is in turn pulled by the latch lever 34 (shown in FIG. 1). As the latch lever 34 is moved to allow movement of the actuator 80 opposite the direction of arrow 86, the actuator 80 is returned to the left by a force applied by a retraction element such as, for example, an actuator spring 90. It is also understood to be within the scope and intent of the present invention that other types of retraction elements may be employed to apply a force to the actuator 80 so as to return it opposite the direction of arrow 86 such as, for example, one or more magnets 69 as are utilized in the retracting device previously described.

The actuator 80 of the present embodiment comprises an elongated member to which the first rotatable mechanism, i.e. rollers 84, and a second rotatable mechanism, i.e. rollers 94, are rotatably attached. The rollers 94 roll against a second abutment surface 81' which, in this embodiment, comprises an adjacent surface 96 of the compression panel 56. As noted above with respect to the first abutment surface 81, it is also understood to be within the scope and intent of the present invention for the second abutment surface 81' to alternatively be mounted opposite the compression panel 56. The inclined surfaces 82 extend along stationary ramps 98 attached to ramp brackets 100. The ramp brackets 100 are in turn fastened to the underlying floor by means of self-threading concrete fasteners 102. A shim 104 is used to align the actuator subassembly 32 with the compression panel 56 in the vertical direction of arrow 106. Each of the ramp brackets 100 additionally includes a plastic bearing plate 110, fastened to the bracket 100 by means of screws 111, to provide a surface along which the actuator 80 slides.

Figure 4:
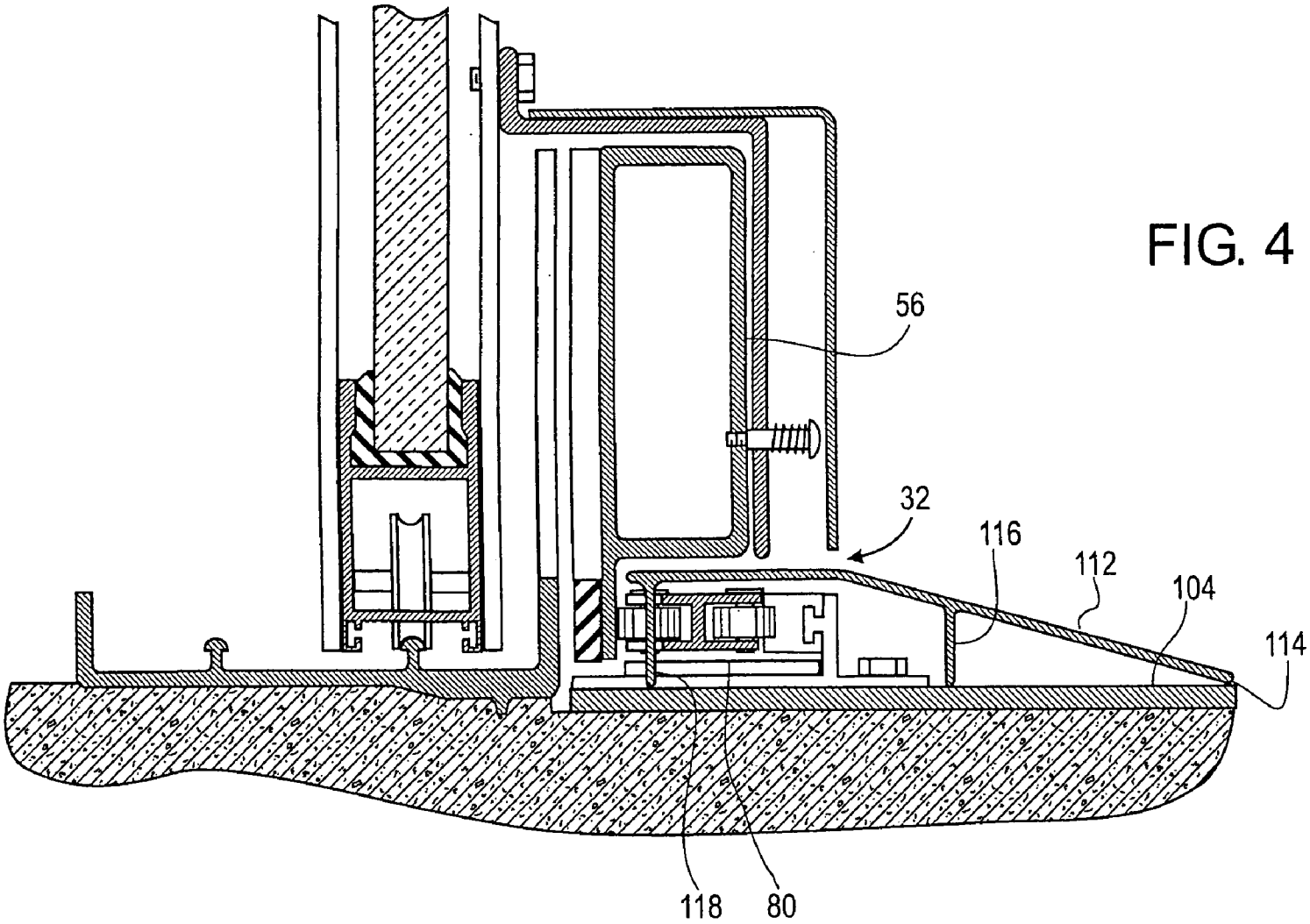
FIG. 4 is a fragmentary cross-sectional elevation of the doorway assembly of FIG. 1 along lines 4—4 thereof showing a sliding door therein in a closed position.
Figure 5:
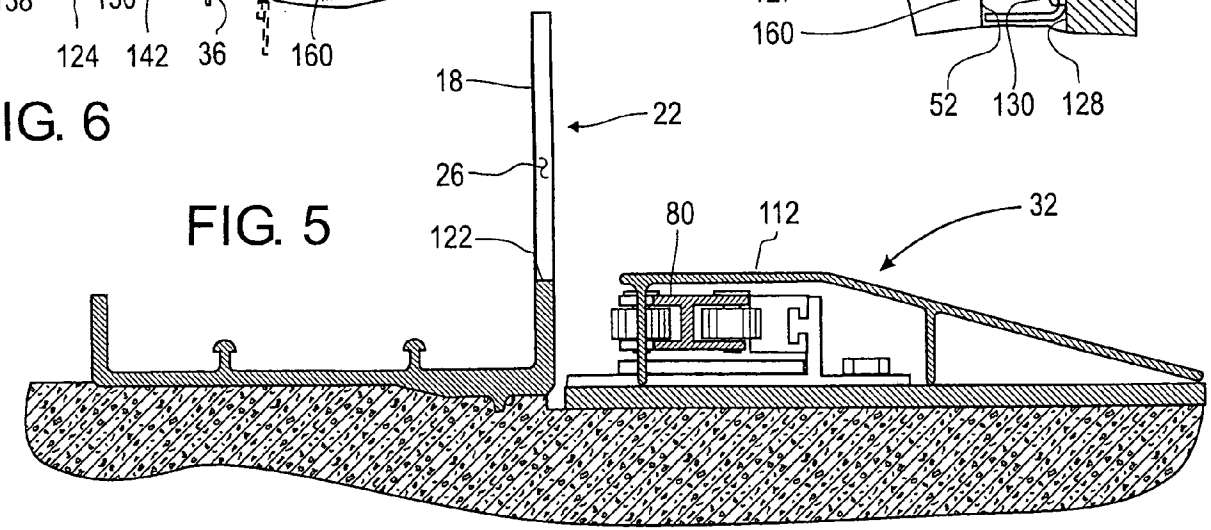
FIG. 5 is a fragmentary cross-sectional elevation of the doorway assembly of FIG. 1 along lines 5—5 thereof showing a passageway formed by opening the sliding door.

FIGS. 4 and 5 are fragmentary cross-sectional elevations of the doorway assembly 10, taken as indicated by section line 4—4 in FIG. 1, with FIG. 4 showing the sliding door 12 in its closed position, and with FIG. 5 showing the passageway 22 provided by opening the sliding door 12.

Referring to FIGS. 2 and 4, the actuator subassembly 32 additionally includes a threshold cover 112, supported on the surface of the shim 104 by its edge 114 and by downward extending ribs 116, 118, with rib 118 being divided into sections with intervening spaces 120. As additionally shown in FIG. 1, the threshold cover 112 extends adjacent the stationary door 14 as well as the sliding door 13.

Comparing FIG. 5 with FIG. 4, when the sliding door 12 is opened, the compression panel subassembly 28 moves with it, leaving a passageway 22 that is substantially unobstructed such that it is easy to walk through and/or to roll a wheelchair through, with the highest elements being the threshold cover 112 and the surface 122 forming the bottom of notch 26 in the barrier plate 18. The actuator 80 of this illustrated embodiment is protected by the threshold cover 112 from being damaged by traffic moving through the passageway 22.

Figure 7:
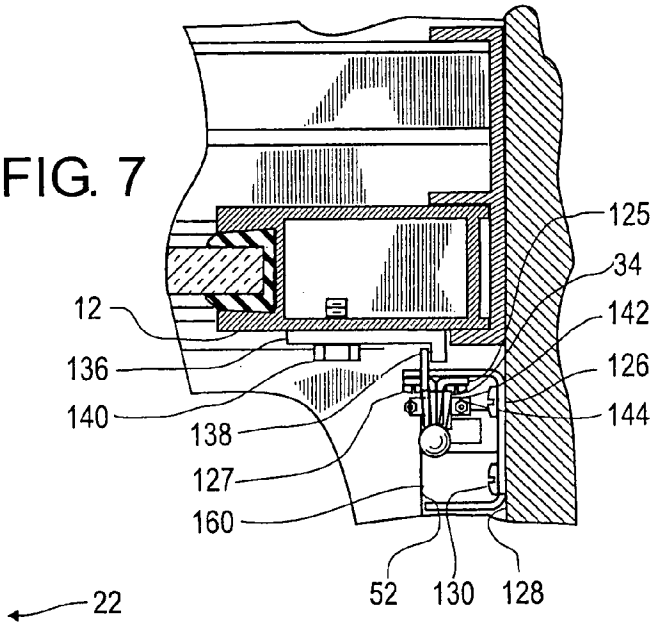
FIG. 7 is a fragmentary cross-sectional plan view of the doorway assembly of FIG. 1 along lines 7—7 thereof.
Figure 6:
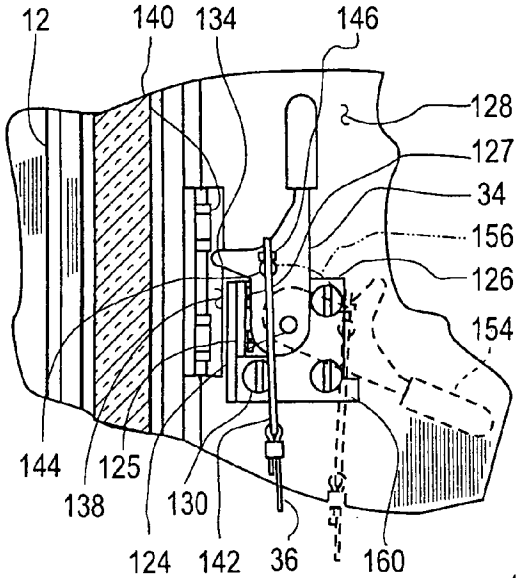
FIG. 6 is a fragmentary cross-sectional elevation of the doorway assembly of FIG. 1 along lines 6—6 thereof showing a latch lever.

The latch lever 34 will now be discussed, with particular reference being made to the embodiment of FIGS. 6 and 7. FIG. 6 is a fragmentary cross-sectional elevation of the doorway assembly 10, taken as indicated by section line 6—6 in FIG. 1 to show one embodiment of the latch lever 34 and associated structures, while FIG. 7 is a fragmentary plan view of the doorway assembly 10, taken as indicated by section line 7—7 in FIG. 1. While FIG. 1 shows the sliding door 12 as partly open, FIGS. 6 and 7 show the door 12 as fully closed.

Figure 14:
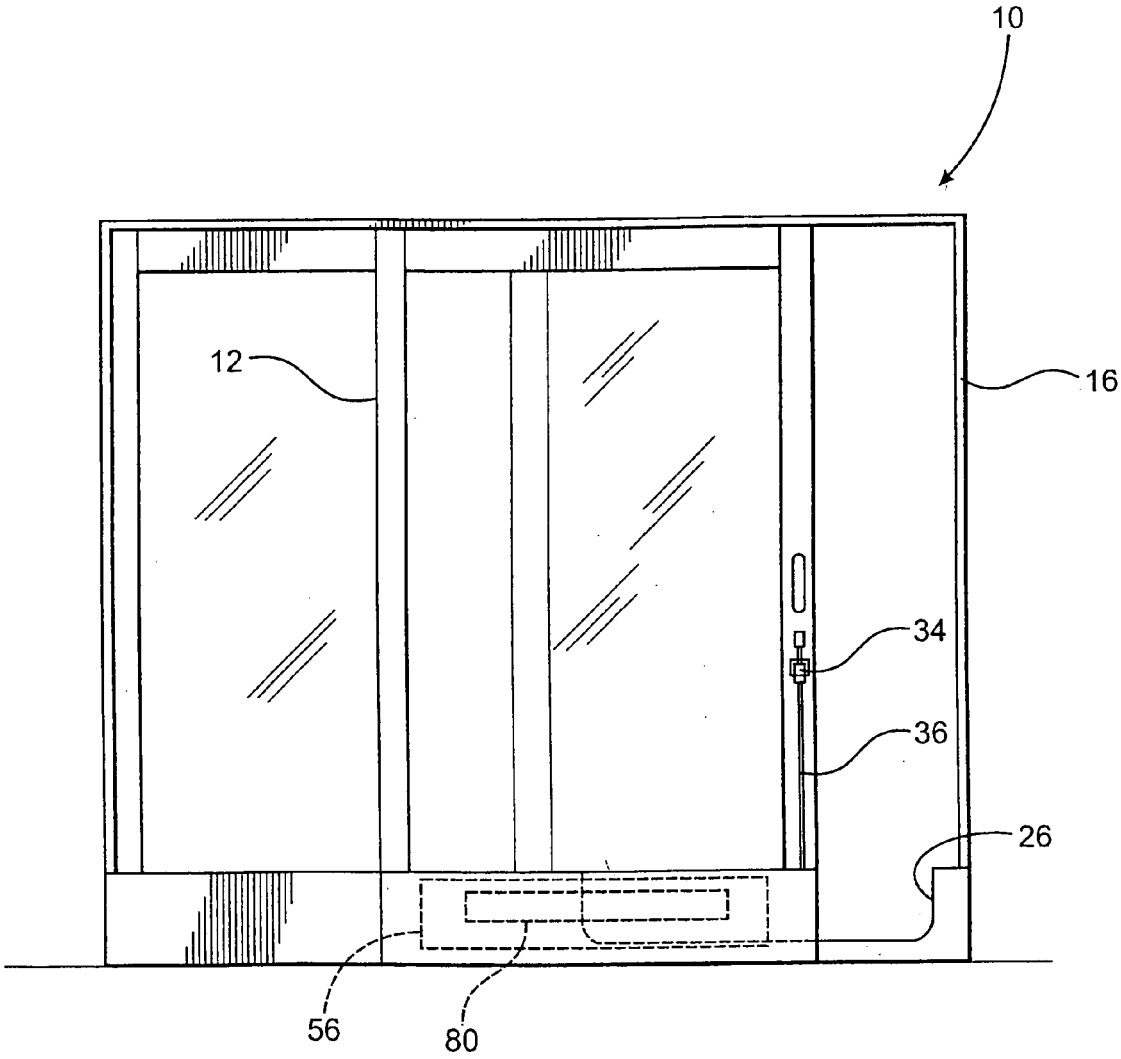
FIG. 14 is a front elevation of one preferred embodiment of a doorway assembly built in accordance with the present invention illustrating a sliding door comprising integral construction, the sliding door being partly open.

In this embodiment, the latch lever 34 is pivotally mounted by a pin 124 on a pair of brackets 125, which are in turn fastened to a mounting bracket 126 by means of screws 127. The mounting bracket 126 is in turn mounted to a wall 128 by a number of screws 130. In at least one embodiment, the latch lever 34 and associated components are interconnected to and movable with the sliding door 12, and in one preferred embodiment, the latch lever 34 and associated components, such as the flexible member 36, are integrally constructed with the sliding door 12, as illustrated in FIG. 14.

In the embodiment of FIGS. 6 and 7, the latch lever 34 is pivoted into a raised position, pulling the actuator 80 in the direction of arrow 86 (shown in FIG. 3) by means of the flexible member 36, so that the compressible gasket 70 contacts and is compressed against the barrier plate 18, thereby forming a fluid impervious seal around the notch 26. As used throughout the specification, "fluid impervious" means that the compressible gasket 70 contacts the barrier plate 18 under sufficient pressure so as to substantially prevent the passage of liquid between the compression panel 56 and the barrier plate 18, where the liquid has a head pressure at least partially defined by the height of the liquid against the barrier plate 18. This fluid impervious seal further defines the sealing engagement between the compression panel 56 and the barrier plate 18.

Preferably, the latch lever 34 additionally includes a locking pawl 134 that prevents the opening of the sliding door 12 from its closed position when the latch lever 34 is in its raised position. In the example illustrated in the figures, a locking plate 136 has been attached to the sliding door 12 to provide a surface 138 to be stopped by the locking pawl 134 if an attempt is made to open the sliding door with the latch lever 34 in its raised position. The locking plate 136 is fastened to the sliding door 112 by a pair of bolts 140.

Referring again to the embodiment illustrated in FIGS. 3, 6, and 7, the flexible member 36 is fastened to a U-shaped attachment frame 142, which is in turn fastened to the latch lever 34 by means of a pin 144. The attachment frame 142 extends through a pair of holes within the pin 144, being held in place by a pair of nuts 146 engaging threads along the ends of the frame 142. The flexible member 36 extends downward from the attachment frame 142 and partly around a pair of pulleys 150, 152, to be attached to the actuator 80 by means of the pin 88. The pulleys 150, 152 may be individually fastened to the floor 20, below the shim 104, and to the wall 128, as shown, or they may be fastened to a common bracket (not shown) that is in turn fastened to the floor 20 or to the wall 128. In one preferred embodiment, one or more pulleys, such as 150 and/or 152 may be integrally constructed with the sliding door.

In the present embodiment, when the sliding door 12 is in the closed position and the latch lever 34 in its raised position, the latch lever 34 must be lowered into the position indicated in FIG. 6 by dashed lines 154 before the sliding door 12 can be opened. During this process, the locking pawl 134 moves out of the path of surface 138 of the locking plate 136, so that the door 12 can be opened. Also, as the lever 34 is lowered, the pin 144 moves along an arcuate path 156, so that the upper end of the flexible member 36 moves downward, allowing the actuator spring 90 to move the actuator 80 to the left, opposite the direction of arrow 86. In at least one embodiment, the arcuate path 156 extends on both sides of the pin 144, so that the latch lever 34 acts as a toggle, being held in both raised and lowered portions by a force applied by the actuator spring 90 through the flexible member 36.

Also, in the present embodiment, while the sliding door 12 remains open, the latch lever 34 may remain in its lowered position, as indicated by dashed lines 154. Then, after the sliding door 12 is fully closed, the latch lever 34 may be rotated into its raised position, with the flexible member 36 pulling the actuator 80 in the direction of arrow 86. As the rollers 84 are pulled up along the inclined surfaces 82, the actuator 80 is also moved in the direction of arrow 66, so that the compressible gasket 70 is compressed against the barrier plate 18. This movement of the latch lever 34 into its raised position may additionally move the locking pawl 134 into place to prevent the re-opening of the sliding door 12.

Figure 9:
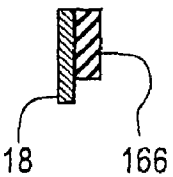
FIG. 9 is a cross sectional view of the barrier plate of FIG. 8 along lines 9—9 thereof.
Figure 8:
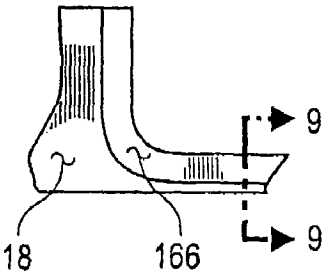
FIG. 8 is a fragmentary elevation of a barrier plate having an alternative compressible gasket for use in the doorway assembly of FIG. 1.

The preceding discussion has described an embodiment wherein the compressible gasket 70 is attached to the an outer surface 72 of the compression panel 56, providing an advantage of moving the compressible gasket 70 out of harm's way with the sliding door 12, so that subsequent movement of individuals through the passageway 22 with the sliding door 12 open will not damage the compressible gasket 70. Nevertheless, it is understood that a compressible gasket 70 may alternatively be attached to the barrier plate 18, as shown in the embodiment of FIGS. 8 and 9. FIG. 8 is a fragmentary elevation of the barrier plate 18, having an elastomeric strip 166 attached thereto, while FIG. 9 is a cross-sectional elevation of this barrier plate 18 and elastomeric strip 166, taken as indicated by section line 9—9 in FIG. 8. The elastomeric strip 166, which is composed, for example, of a material such as a closed cell neoprene foam, is adhesively attached to the barrier plate 18.

Figure 10:
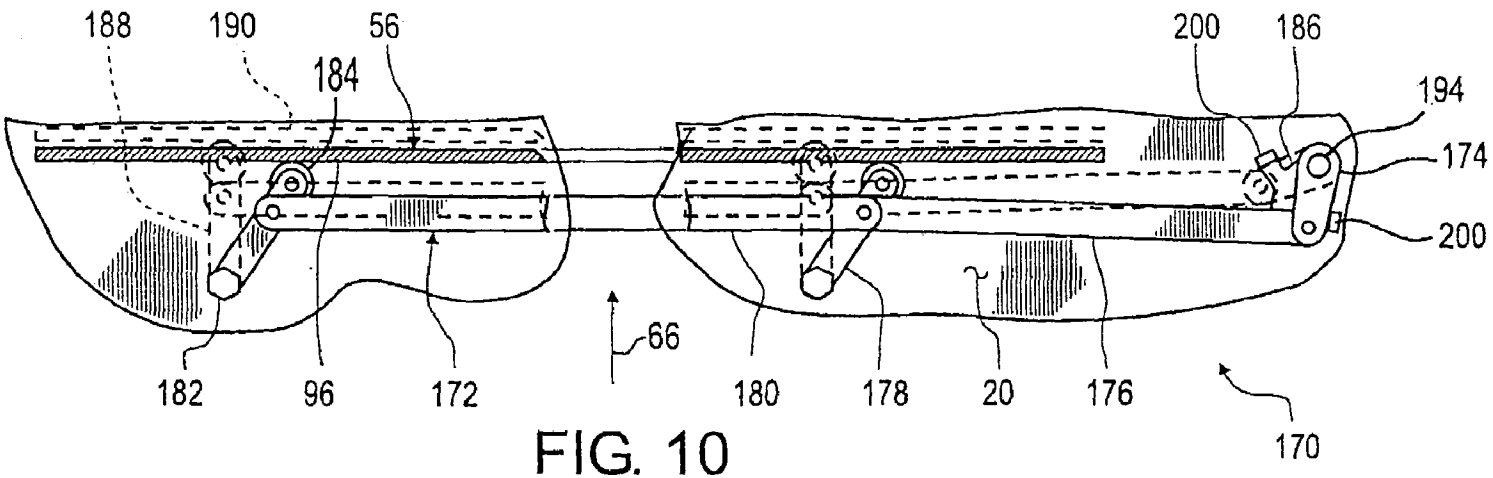
FIG. 10 is a fragmentary plan view of one alternative actuator for use in the doorway assembly of FIG. 1.

FIG. 10 is a plan view of another embodiment of an actuator 170, which is composed of a parallelogram linkage 172 driven by a crank 174 through a crank link 176. The parallelogram linkage includes a pair of arms 178 and a connecting link 180. Each of the arms, which is pivotally attached to the floor 20 by means of a shoulder screw 182, includes a rotatably mounted roller 184. As the crank 174 is rotated between the position in which it is shown and the position indicated by dashed lines 186, the linkage 178 moves from the position in which it is shown into the position indicated by dashed lines 188, with the rollers 184 rolling against the adjacent surface 96 of the compression panel 56, so that this portion of the panel 56 is moved in the direction of arrow 66 into the position indicated by dashed lines 190. When the crank 174 is rotated from the position indicated by dashed lines 186 into the position in which it is shown to be in, this process is reversed, with the springs 68, shown in FIG. 2, returning the compression panel 56 from the position indicated by dashed lines 190.

Figure 11:
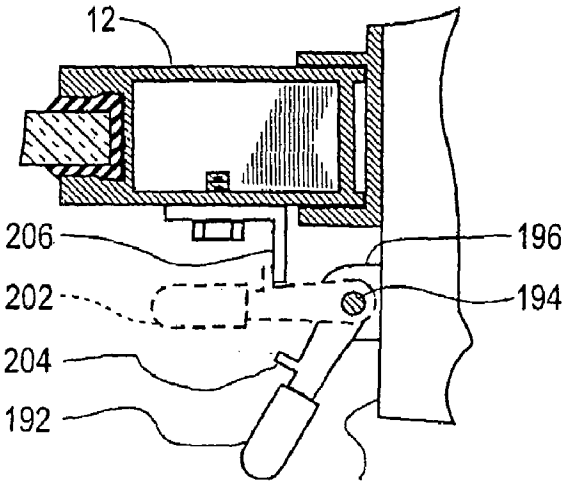
FIG. 11 is a cross-sectional plan view showing an alternative latch lever for use with the actuator of FIG. 10.

FIG. 11 is a partly sectional plan view showing a cross-section of the sliding door 12, together with a plan view of a latch lever 192 turning the crank 174 by means of a shaft 194 extending downward between the lever 192 and the crank 174, the shaft 194 being pivotally mounted in a bearing block 196 attached to the wall 128 and in a bearing plate (not shown) attached to the floor 20. In one embodiment, the bearing plate may also include a pair of tabs 200 limiting the rotational movement of the crank 174. As the latch lever 192 moves from the position in which it is shown into the position indicated by dashed lines 202, the crank 174 is moved from the position in which it is shown into the position indicated by dashed lines 186, so that the compressible gasket 70 or 166 is clamped by the compression panel 56. As the latch lever 192 is then returned to the position in which it is shown, the compressible gasket 70 or 166 is released. Preferably, the latch lever 192 also includes a locking pawl 204, which stops movement of the sliding door 12 from its closed position by contacting a stop plate 206 attached to the door 12 when the latch lever is in the position indicated by dashed lines 202.

Figure 12:
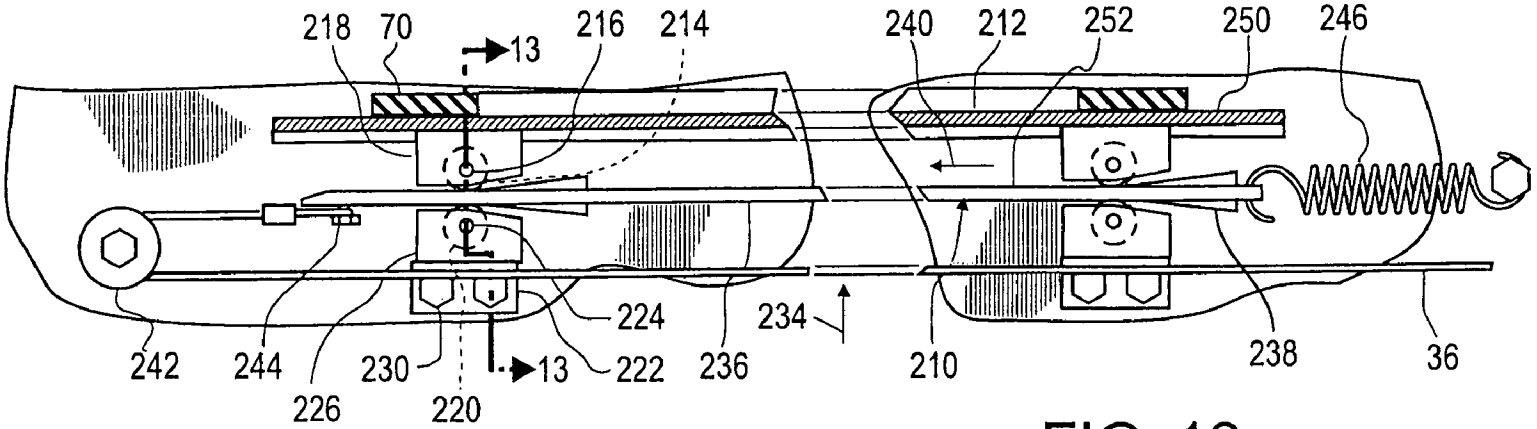
FIG. 12 is a fragmentary plan view of another alternative actuator for use in the doorway assembly of FIG. 1.
Figure 13:
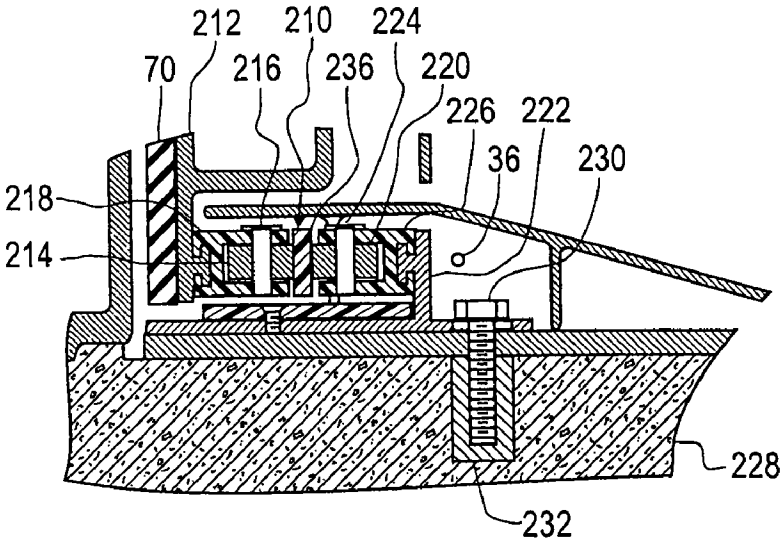
FIG. 13 is a fragmentary cross-sectional elevation of a doorway assembly including the actuator of FIG. 12 along lines 13—13 thereof.

Yet another alternative embodiment of actuator 210 will now be discussed with particular reference to FIGS. 12 and 13. FIG. 12 is a fragmentary plan view of another alternative embodiment of actuator 210, along with associated elements of a doorway assembly, while FIG. 13 is a fragmentary cross-sectional view thereof, taken as indicated by section lines 13—13 in FIG. 12. For use with this actuator 210, a compression panel 212, which is otherwise similar to the compression panel 56 described above, is provided with a pair of rollers 214, which are rotatably mounted on pins 216 attached within attachment blocks 218 clamped in place on the compression panel 212. Similarly, a pair of rollers 220 is rotatably mounted to stationary brackets 222 by means of pins 224 extending within attachment blocks 226. The attachment blocks 218, 226 may be metal or plastic. The stationary brackets 222 are attached to the floor by means of bolts 230, which may extend into bolt anchors 232, or which may be fastened directly into the floor by means of self-tapping threads. The stationary brackets 222 are disposed so that the rollers 220 are aligned with the rollers 214 in the direction of arrow 234.

In this embodiment, actuator 210 includes an elongated bar 236 and a pair of ramp structures 238, which are disposed along the actuator 210 to move between the opposing rollers 214 and 220 as the actuator 210 is moved in the engagement direction of arrow 240. The rollers 214 are held in contact with the actuator 210 by means of a number of springs (not shown), which act in the manner of springs 68, described above in reference to FIG. 3. Thus, when the actuator 210 is pulled in the engagement direction of arrow 240 the compression panel 212 moves in the direction of arrow 234. For example, the flexible member 36 is directed around a floor-mounted pulley 242 to be attached to the actuator 210 by means of a screw 244, so that the actuator 210 is moved in the direction of arrow 240 in response to upward movement of the latch lever 34, as described above. This movement of the compression panel 212 in the direction of arrow 234 compresses the compressible gasket 70 in the manner described above. An actuator spring 246 is provided to maintain tension within the flexible member 36 and to return the actuator 210 in the direction opposite that of arrow 240.

While the ramp structures 238 of this embodiment are shown as extending outward from both sides of the elongated bar 236, it is understood that these ramp structures 238 may alternately extend outward only from one side, either in the direction of arrow 234 or opposite thereto.

It is additionally understood that the embodiment of the actuator 170 may otherwise be moved by the flexible member 36 and by the actuator spring 90, generally as described in reference to FIG. 3, and that the embodiment of the actuator 80 may alternately be moved by a linkage in the manner generally described in reference to FIGS. 10 and 11.

Figure 16:
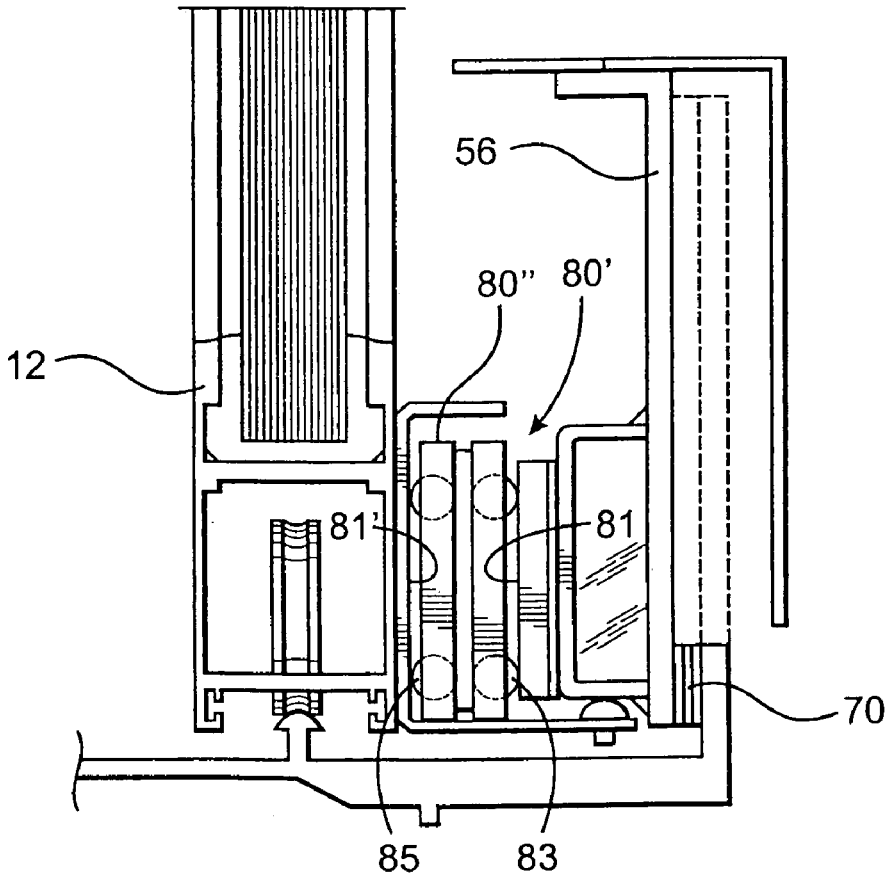
FIG. 16 is a partial cross-sectional elevation of a doorway assembly including the embodiment of the actuator of FIG. 15.

One preferred embodiment of the present invention comprises an actuator 80' as illustrated in FIGS. 15, 15A, and 16. In particular, FIG. 15 is a partial plan view of an actuator 80' comprising an elongated member 80" having a first rotatable mechanism 83 rotatably mounted thereto, the first rotatable mechanism 83 structured to contact a first abutment surface 81 when the elongated member 80" is disposed in an engaged position. The first rotatable mechanism 83 comprises at least one, but preferably a plurality of ball bearings, as illustrated in the figures. In addition, the elongated member 80" comprises a second rotatable mechanism 85 structured to contact a second abutment surface 81' when disposed in the engaged position. As with the first rotatable mechanism 83, the second rotatable mechanism 85 comprises at least one, but preferably a plurality of ball bearings, once again, as illustrated.

The operation of the actuator 80' of this preferred embodiment is essentially the same as indicated above for actuator 80. In particular, a latch lever 34 may be interconnected to the actuator 80' by a flexible member 36, and upon rotation of the latch lever 34 into a raised position, the flexible member 36 pulls the actuator 80' such that the first and second rotatable mechanisms 83 and 85 contact the first and second abutment surfaces 81 and 81', respectively. This causes the compression panel 56 to be moved toward the barrier plate 18 such that the compressible gasket 70 contacts and is compressed against the barrier plate 18 forming a fluid impervious seal therebetween and at least partially defining the sealing engagement.

The foregoing embodiments of the present invention may be applied to a doorway of a building during construction. Alternately, the invention may be applied to an existing doorway after the construction of the building by cutting the notch 26 in the existing barrier plate 18 and by fastening the various components of the invention in place as described on the floor, wall, and the sliding door.

As indicated above, in at least one embodiment of the present invention, some components may be interconnected to the door and are, thus, moveable therewith. For example, in one preferred embodiment, the compression panel 56 is interconnected to and moveable with the door, such as sliding door 12. In one further preferred embodiment, the compression panel 56 is integrally constructed with the sliding door 12, as illustrated in FIG. 14, so as to facilitate the installation of the assembly 10 of the present invention during new construction of a building. More in particular, the integral construction of the compression panel 56 with the sliding door 12 allows it to be hung in manner similar to any standard door, thereby permitting widespread usage of the present invention utilizing standard construction techniques. Integral construction further allows the present invention to be installed in a doorway in an unobtrusive manner in that neither the appearance or movement of the door are significantly varied from that of a standard door which does not comprise the invention.

In yet another preferred embodiment of the present invention, the actuator 80 or 80' is also interconnected to the sliding door 12 and, similar to the compression panel 56, is moveable therewith. Also, as with the compression panel 56, the actuator 80 or 80' is integrally constructed with the sliding door 12, in one preferred embodiment. As illustrated in the embodiment of FIG. 14, the latch lever 34 and the flexible member 36 are also mounted to and moveable with sliding door 12, such as may be accomplished via integral construction with the sliding door 12. In one preferred embodiment, the compression panel 56, the actuator 80, the latch lever 34, and the flexible cable 36 all comprise integral construction with the sliding door 12 and are all moveable therewith. As noted above, such integral construction is important in that it allows a sliding door 12 comprising components of the present invention to be installed using standard construction techniques, which will permit widespread usage of the present invention.

Since many modifications, variations and changes in detail can be made to the described preferred embodiment of the invention, it is intended that all matters in the foregoing description and shown in the accompanying drawings be interpreted as illustrative and not in a limiting sense. Thus, the scope of the invention should be determined by the appended claims and their legal equivalents.

Now that the invention has been described,

What is claimed is:

1. A doorway assembly structured to be disposed in a doorway of a structure comprising:

a doorframe including a barrier plate, said barrier plate comprising at least one notch structured to provide a substantially unobstructed passageway through the doorway, a sliding door disposed in an operative association with said doorframe such that said sliding door is movable between an open position and a closed position, said sliding door comprising a compression panel interconnected to and moveable therewith said compression panel structured to be disposed into and out of a sealing engagement with said barrier plate, said compression panel comprising a compressible gasket mounted thereto, said sealing engagement partially defined by said compressible gasket contacting said barrier plate proximate said notch so as to substantially prevent passage of liquid between said compression panel and said barrier plate at least proximate said notch, an actuator interconnected to and moveable with said sliding door, said actuator structured to operatively engage a portion of said compression panel and to dispose said compression panel into said sealing engagement with said barrier plate, said actuator comprising an elongated member disposed adjacent to and movable along a portion of a first abutment surface between an engaged position and a disengaged position, said elongated member comprising a first rotatable mechanism mounted thereto and disposed in contact with said portion of said first abutment surface, and a second rotatable mechanism mounted thereto and disposed in contact with a portion of a second abutment surface, and said compression panel further comprising a retracting device structured to dispose said compression panel out of said sealing engagement with said barrier plate, wherein said retracting device comprises at least one magnet.

2. The assembly as recited in claim 1 wherein said first rotatable mechanism comprises at least one ball bearing.

3. The assembly as recited in claim 1 wherein said second rotatable mechanism comprises at least one ball bearing.

4. The assembly as recited in claim 1 wherein said first rotatable mechanism comprises a plurality of ball bearings.

5. The assembly as recited in claim 1 wherein said second rotatable mechanism comprises a plurality of ball bearings.

6. The assembly as recited in claim 1 wherein said compression panel is integrally constructed with said sliding door.

7. The assembly as recited in claim 1 wherein said actuator is integrally constructed with said sliding door.

* * * * *